US007185954B2

(12) United States Patent
Asakura

(10) Patent No.: US 7,185,954 B2
(45) Date of Patent: Mar. 6, 2007

(54) METHOD AND DEVICE FOR REMOVING PART OF CONCRETE STRUCTURE

(76) Inventor: Kensuke Asakura, 29-16, Kinuta 1-chome, Setagaya, Tokyo 157-0073 (JP)

( * ) Notice: Subject to any disclaimer, the term of this patent is extended or adjusted under 35 U.S.C. 154(b) by 404 days.

(21) Appl. No.: 10/363,623

(22) PCT Filed: May 15, 2001

(86) PCT No.: PCT/JP01/04048

§ 371 (c)(1),
(2), (4) Date: Mar. 3, 2003

(87) PCT Pub. No.: WO01/88310

PCT Pub. Date: Nov. 22, 2001

(65) Prior Publication Data

US 2004/0040254 A1 Mar. 4, 2004

(30) Foreign Application Priority Data

May 15, 2000 (JP) ..... 2000-141077
May 22, 2000 (JP) ..... 2000-150067

(51) Int. Cl.
*E01C 11/04* (2006.01)
*E04G 23/08* (2006.01)

(52) U.S. Cl. ..... 299/21; 92/103 M; 92/91; 299/15

(58) Field of Classification Search ..... 299/15, 299/20, 21, 22, 23; 92/47, 103 M, 91
See application file for complete search history.

(56) References Cited

U.S. PATENT DOCUMENTS 2,289,549 A * 7/1942 Norstrom ..... 92/91
4,865,391 A * 9/1989 Chevakin et al. ..... 299/23
5,087,100 A * 2/1992 Bruce ..... 299/15

FOREIGN PATENT DOCUMENTS

JP 55042971 3/1980
JP 7305521 11/1995
JP 7329052 12/1995
JP 8060875 3/1996

* cited by examiner

*Primary Examiner*—John Kreck
(74) *Attorney, Agent, or Firm*—Bachman & LaPointe, P.C.

(57) ABSTRACT

This invention refers to a method for removing a part of concrete construction that comprises a base concrete; a reinforced concrete formed on the base concrete; rebars embedded in the base concrete and upwardly extending through the reinforced concrete; the method comprising the steps of: forming a slit in the reinforced concrete and disconnections at an intermediate of the rebars; applying an expansion force on opposite surfaces of the slit in the reinforced concrete to simultaneously break a boundary plane of the reinforced concrete; and removing the moved portion of the reinforced concrete from the base concrete as a scrap. Also, the present invention provides a flat jack suitable to break boundary planes of the scrap wherein the flat jack comprises two metallic plates joined to each other, and an inlet for introducing into the jack pressurized fluidic material to inflate the jack in order to produce a great expansive force.

8 Claims, 3 Drawing Sheets

METHOD AND DEVICE FOR REMOVING PART OF CONCRETE STRUCTURE

TECHNICAL FIELD

This invention relates to a method and an apparatus for removing a part of a concrete construction. Specifically, bridges built for elevated highways are provided with roadway expansion joints mounted on the bridges, and the expansion joints are exchanged with new ones after elapse of some service life in a manner of removing the expansion joints and adjoining reinforced concretes for surrounding the expansion joints from slabs of the highways. The present invention provides a method and an apparatus suitable to remove such reinforced concretes.

BACKGROUND OF THE INVENTION

As shown in Japanese Patent Disclosure No. 57-77759, the inventor proposed a method and an apparatus for exchanging an expansion joint used for long period of time by providing each iron bar with a tensely weakened portion and embedding the iron bars and elongated inflatable flat vessels of metallic material in a reinforced concrete for fixing an expansion joint. In exchange, pressurized liquid is supplied into the vessels to cause them to inflate by the internal pressurized liquid so that the iron bars break at the weakened portion to separate and elevate a part of the reinforced concrete from a base concrete for easy removal of the reinforced concrete. However, this method is defective and almost unpractical in that it involves demolishing noise when the reinforced concrete is broken and crushed by drills or breakers operated for long hours. Also, in some cases, a base concrete beneath the reinforced concrete may unnecessarily or accidentally be broken by excessive crushing operation of breakers, requiring an additional work to repair the broken base concrete.

An inflatable flat vessel is formed by pressing a metallic pipe into a flat shape with bent side edges of so larger radius and thickness in cross section as to avoid metal fatigue that may occur at the bent edges by pressing. In another aspect, a recent and general method for demolishing concrete constructions utilizes a diamond cutter that has a rotatable circular blade with tips of diamond powder attached to an outer periphery of the blade. The rotating blade may cut a reinforced concrete to form a slit of thin width, for example, less than approximately four (4) millimeters width. However, cutters of this kind have not been used in removing a reinforced concrete for fixing expansion joints The present invention provides a method and an apparatus for easily removing a part of concrete construction such as a reinforced concrete for fixing expansion joints in a shorter period of time without giving rise to noise pollution, avoiding damage to a base concrete beneath the reinforced concrete by excessive demolition.

SUMMARY OF THE INVENTION

The present invention refers to a method for removing a part of concrete construction that comprises a base concrete (10); a reinforced concrete (23) formed on the base concrete (10) from which at least a segment of the reinforced concrete (23) is removed; and rebars (12) embedded in the base concrete (10) and upwardly extending through the reinforced concrete (23); the method comprising the steps of: forming a slit (28, 29) in the reinforced concrete (23) and disconnections (45) at an intermediate of the rebars (12) to form the segment of the reinforced concrete (23) wherein the slit (28, 29) extends from a top surface of the reinforced concrete (23) slightly above a boundary plane (22) between the base concrete (10) and reinforced concrete (23) or down to the base concrete (10), wherein the slit (28, 29) also extends transversely to the moved direction of the segment, and wherein the slit (28, 29) is formed in the vicinity of a rear end of the reinforced concrete (23); applying an expansion force on opposite surfaces of the slit (28, 29) in the reinforced concrete (23) or if available on opposite cut ends of the disconnections (45) of the rebars (12); thereby moving one of the opposite surfaces of the slit (28, 29) away from the other of the opposite surfaces to move the segment in the predetermined moved direction once or several times, while simultaneously breaking the boundary plane (22) to separate the segment from the base concrete (10) into a scrap, and removing the scrap from the base concrete (10).

The present invention also refers to a flat jack that comprises two metallic plates joined to each other with a circumferential joint portion formed along the whole periphery of the metallic plates, and an inlet (36) for introducing into the jack (33) pressurized fluidic material such as water, oil, gel or vaseline except gas to inflate the jack (33) that thereby produces a great expansive force.

BEST MODE FOR CARRYING OUT THE INVENTION

Figure 1:
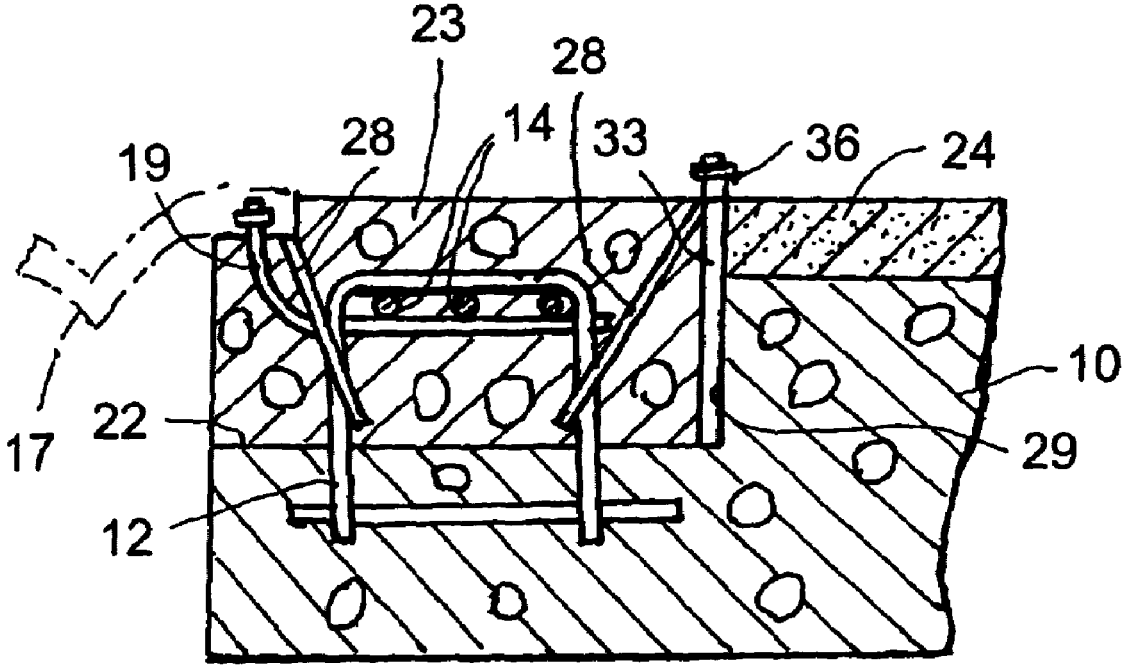
FIG. 1 is a longitudinal section view of an embodiment according to the present invention showing a reinforced concrete for fixing an expansion joint to be removed.

An embodiment of the present invention is described hereinafter in connection with the drawings.

The embodiment of the present invention shown in the drawings is applied to a technique for removing a reinforced concrete that mounts an expansion joint on a base concrete of a bridge.

Figure 2:
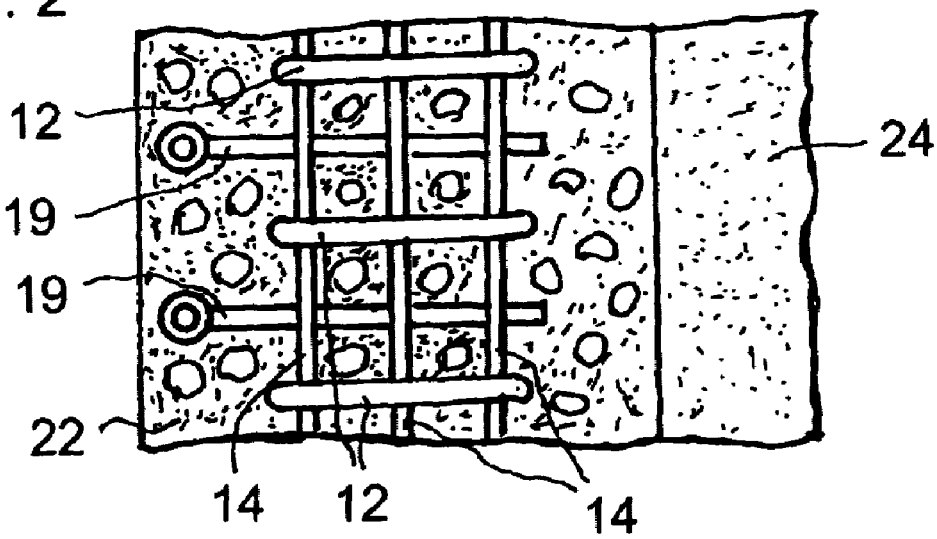
FIG. 2 is a plan view of the reinforced concrete with vertical reinforcing rods upward extending from a base concrete to the reinforced concrete and with additional reinforcing rods connected to the vertical reinforcing rods.

In FIGS. 1 and 2, a reference numeral "10" denotes an irremovable roadway slab or base concrete of a concrete construction, "12" symbolizes a plurality of reinforcing iron rods or rebars of generally inverted U-shape embedded in base concrete 10 and arrayed in a transverse direction at given intervals. Each of rebars 12 has a horizontal connecting portion and two vertical arms extending from both ends of the connecting portion into base concrete 10. A plurality of additional rebars 14 are attached at right angles to a bottom side of the horizontal connecting portion. As shown in the drawings, anchor bolts 19 for an expansion joint 17 are secured to rebars 14. A boundary plane 22 is formed on an upper surface of base concrete 10. Rebars and anchor bolts 19 are embedded in a reinforced concrete 23 formed on boundary plane 22 to provide a reinforced concrete 23 for fixing expansion joint 17. Reinforced concrete 23 has the length of for example approximately 30 centimeters and the thickness of less than approximately 20 centimeters. In exchange of expansion joint 17 with new one, reinforced concrete 23 provides a dismantled scrap removed for reconstruction. Reference numeral 24 indicates a pavement concrete.

Reinforced concrete 23 is taken away as follows: Slits 28 are formed by driving commercially available diamond cutters to transversely and downward extend immediately above boundary plane 22, and rebars 12 are simultaneously cut to form disconnections 45 of rebars 12. Arms of rebars 12 arranged in two transverse rows are cut in a line twice to finish cutting operation. A vertical slit 29 can be formed in the vicinity of pavement concrete 24 by means of the above-mentioned diamond cutters to extend between an upper surface of reinforced concrete 23 and boundary plane 22.

Figure 4:
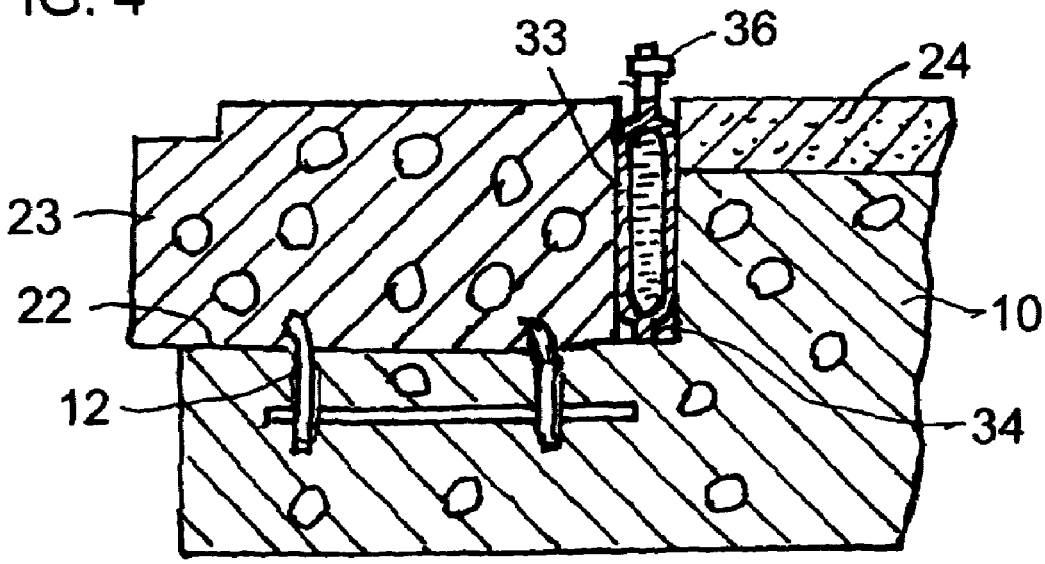
FIG. 4 is a longitudinal section view of the moved reinforced concrete.
Figure 5:
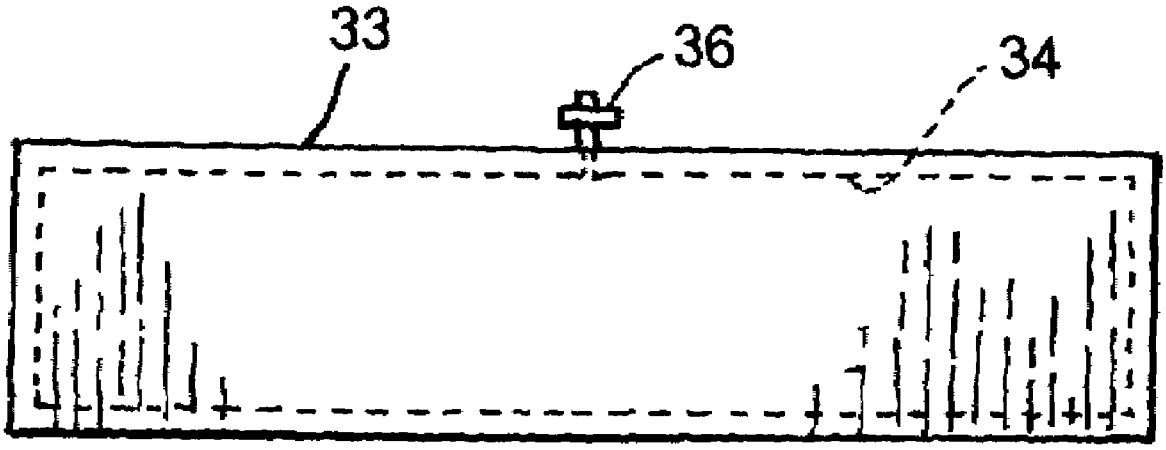
FIG. 5 is a front view of a jack.

FIG. 5 shows a jack 33 that can be inserted into vertical slit 29 and that is disposable after used once. Jack 33 is formed by putting two metallic plates of same shape into contact to each other and then welding or brazing outer periphery of the metallic plates to form a joined portion 34. In use, when pressurized fluidic material such as water, oil or vaseline except gas is introduced from an inlet 36, jack 33 inflate to produce a great expansive force for moving reinforced concrete 23 as shown in FIG. 4.

Figure 3:
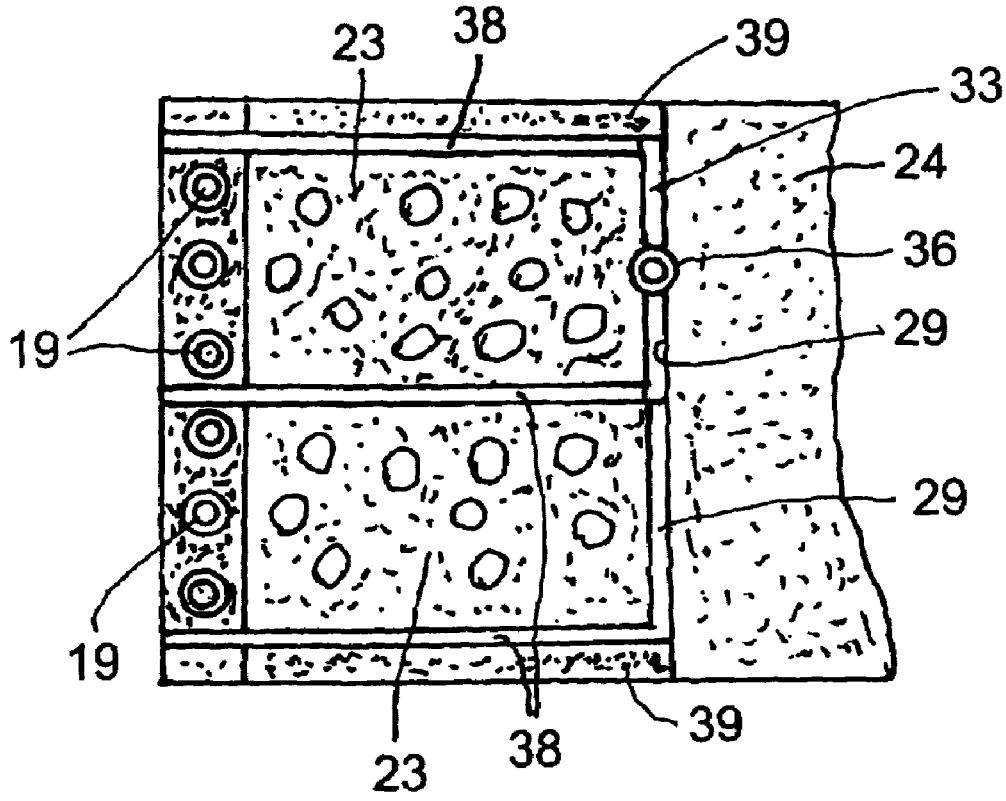
FIG. 3 is a plan view of the reinforced concrete formed with slits for removing the reinforced concrete.

To move reinforced concrete 23 of suitable width by a slight distance a few or several times for removal of the reinforced concrete 23 from base concrete 10, it is necessary to cut longitudinal slits in the moved direction of each segment at opposite transverse sides. In this case, rebars may be simultaneously cut if any across a forming track of slit. As shown in FIG. 3, slits 38 are formed at transverse intervals of for example 3.5 meters, in length approximately equal to that of reinforced concrete 23 and in depth between about 10 to 20 centimeters generally reaching boundary plane 22. Two longitudinal slits 38 may be formed only at opposite sides of reinforced concrete 23 if transverse width of reinforced concrete 23 is less than about 3.5 meters.

In operation, pressurized fluid is supplied into jack 33 shown in FIG. 1 to inflate jack 33 by pressurized fluid therein so that jack 33 produces a great expanding force for moving reinforced concrete 23 by a slight distance as illustrated in FIG. 4, breaking boundary plane 22 between reinforced concrete 23 and base concrete 10. In a preferred embodiment of the present invention, if reinforced concrete 23 is moved once, it can be removed from concrete base 10 by lifting and transporting it by a crane onto a truck. It also is possible to easily divide reinforced concrete 23 into small pieces for transportation.

In the aforementioned embodiment, slits 28 and disconnections 45 are simultaneously formed, and jacks 33 can be put in a space defined by slits 29. Instead, reinforced concrete 23 can easily broken by inserting jack 33 into a right side slit 28 shown in FIG. 1 and then supplying pressurized fluid into jack 33. However, it would naturally be possible to easily remove minor residual concrete portions and rebars above boundary plane 22 by utilizing any prior art tool. This will be a very effective method when slits 28 are formed to extend around boundary plane 22.

INDUSTRIAL APPLICABILITY

As the present invention is constructed as above-mentioned, removing operation can be carried out in a very short period of time with reduced noise pollution for example to remove a part of concrete construction such as a scrap of reinforced concrete 23 for fixing expansion joint 17. In this case, the present invention is very advantageous in that no damage is done to remaining base concrete 10 during operation.

Jacks 33 of disposable type can easily be made and inserted into narrow slits 28, 29 to produce great expanding force and thereby remove scraps that include reinforced concretes 23.

What is claimed is:

1. A method for removing a part of concrete construction that comprises a base concrete; a reinforced concrete formed on said base concrete from which at least a segment of said reinforced concrete is removed; and rebars embedded in said base concrete and upwardly extending through said reinforced concrete; the method comprising the steps of:

forming a slit in said reinforced concrete and disconnections at an intermediate of said rebars to form said segment of said reinforced concrete wherein said slit extends from a top surface of the reinforced concrete slightly above a boundary plane between said base concrete and reinforced concrete or down to said base concrete, wherein said slit also extends transversely to the moved direction of said segment, and wherein said slit is formed in the vicinity of a rear end of the reinforced concrete;

applying an expansion force on opposite surfaces of said slit in said reinforced concrete or if available on opposite cut ends of the disconnections of said rebars;

thereby moving one of said opposite surfaces of said slit away from the other of said opposite surfaces to move said segment in the predetermined moved direction once or several times, while simultaneously breaking said boundary plane to separate the segment from the base concrete into a scrap, and removing the scrap from the base concrete.

2. The method of claim 1, further comprising forming at least a longitudinal slit in said reinforced concrete to:

(a) divide the reinforced concrete into a plurality of transverse segments widthwise separated by said longitudinal slits, break said boundary plane, and then move the transverse segments plural times, or (b) separate the segment from at least an uncut area connected to a transverse side of the segment, wherein said slit is formed in said reinforced concrete adjacent to said uncut area, and wherein said slit extends in a same direction as the moved direction of the segment, lengthwise of the segment and in the depths from the top surface of the reinforced concrete to the boundary plane.

3. The method of claim 2, wherein said slit is formed in said reinforced concrete and said disconnections are formed in said rebars by driving a circular diamond cutter with blades of diamond powder secured to an outer periphery of the cutter.

4. The method of claim 3, further comprising inserting a flat jack into said slit, said flat jack being formed by putting two metallic plates into contact to each other and joining outer periphery of the metallic plates by welding or brazing; and supplying into the flat jack pressurized fluid selected from fluidic material such as water, oil, gel and Vaseline except gas from an inlet provided in said jack to inflate the jack thereby to break the boundary plane between the reinforced and the base concrete, and move the segment.

5. The method of claim 4, wherein said base concrete is for a pavement slab of a bridge, and said segment is for the reinforced concrete for fixing a roadway expansion joint of a bridge.

6. A flat jack comprising two metallic plates of a substantially same shape placed together in contact with each other thereby eliminating any air space between the contacting plates, said metallic plates being joined to each other along a whole periphery of said metallic plates to form a circumferential joint portion, and an inlet secured to said metallic plates for introducing pressurized liquid material free of gas between said metallic plates to produces an expansive force for separating the plates except at the circumferential joint portion thereby inflating the jack.

7. A flat jack of claim 6, wherein said liquid material is selected from the group consisting of water, oil, gel and Vaseline.

8. A flat jack of claim 6, wherein the whole periphery of said metallic plates is welded or brazed to form the joint portion.

* * * * *